United States Patent [19]

Schuegraf

[11] 4,295,109

[45] Oct. 13, 1981

[54] RECTANGULAR WAVE GUIDE ELBOW BENT ACROSS THE NARROW SIDE WITH CAPACITIVE LOADING

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 101,577

[22] Filed: Dec. 10, 1979

[30] Foreign Application Priority Data

Dec. 29, 1978 [DE] Fed. Rep. of Germany ..... 2856733

[51] Int. Cl.[3] ..... H01P 1/02

[52] U.S. Cl. ..... 333/249; 333/33

[58] Field of Search ..... 333/248, 249, 33, 34

[56] References Cited

U.S. PATENT DOCUMENTS 2,737,634 3/1956 Lewin et al. ..... 333/249

OTHER PUBLICATIONS

"Taschenbuch der Hochfrequenztechnic", Springer-Verlag, Berlin, 1962; pp. 401-402.

*Primary Examiner*—Marvin Nussbaum

*Attorney, Agent, or Firm*—Hill, Van Santen, Steadman, Chiara & Simpson

[57] ABSTRACT

A rectangular wave guide H-elbow bent across the narrow side of the wave guide and having its outer corner flattened by a symmetrically angled conducting plane. The present invention provides for the reduction of the reflection factor in such elbow by providing that the relative corner flattening of the wave guide produces a value of $x_H/a$ greater than 0.73 wherein a is the length of the wide side of the wave guide and $x_H$ is the distance from the apex of the wave guide before it is flattened by the conducting plane to the junction of the conducting plane with the narrow side of the wave guide. Furthermore, capacitive loading means of cylindrical form are arranged in the area of the geometrical median w of the bend of the wave guide and being in the form of conductive cylinders 1 or 3 as illustrated in FIGS. 2 and 3.

3 Claims, 5 Drawing Figures

RECTANGULAR WAVE GUIDE ELBOW BENT ACROSS THE NARROW SIDE WITH CAPACITIVE LOADING

BACKGROUND OF THE INVENTION

1. Field of the Invention

This invention relates to rectangular wave guide elbows such as H-elbows which are bent across the narrow dimension of the wave guide and which have outer corners which are symmetrically angled with a conductive flattening plane.

2. Description of the Prior Art

Such elbows are known and are described in the publication "Taschenbuch der Hochfrequenztechnik" by H. Meinke and F. W. Gundlach, Springer Verlag, 2nd Edition, 1962, at pages 401 and 402. Such elbows are employed in various microwave circuits which utilize rectangular wave guides. By using angled wave guides, a more compact structure is achieved relative to the comparable low refraction circular arc elbows, particularly when used with wave guide diplexers of different types as, for example, frequency diplexers, polarization filters, wave mode filters, etc. Generally, wave guides with a rectangular cross-section having side ratio a:b=2:1 are most frequently used. Such wave guides can be used in the relative frequency range for the maximum band width of $f_o:f_u=2:1$ for the $TE_{10}$ wave. The above referenced publication discloses that the reflection of an H-elbow can be reduced if the external corner of the elbow is symmetrically flattened with a conductive plane and this publication teaches that corner flattenings or smoothings of various degrees can be utilized and that there is an optimum cathetus length $x_{Ho}$ as illustrated in FIG. 1*b* which is the distance from the apex of the untruncated elbow to the junction of the smoothing conductive plane with the narrow side of the wave guide as illustrated. This dimension has a ratio relative to the wide dimension of the wave guide of 0.64 for optimum conditions as described in the previously referenced publication. For this cathetus dimension ratio of 0.64 the reflection of an H-elbow will remain under r=16.7% in the frequency range of a rectangular wave guide over the frequency range of $1.25fcTE_{10}$ through $1.9fcTE_{10}$. Only in smaller frequency bands within this range can smaller reflections be achieved and for this purpose the cathetus dimension can be changed somewhat relative to $x_{Ho}$ according to the position of the partial frequency band within the full wave guide frequency band range.

FIG. 1*a* illustrates the respective conductive ripple s for H-elbows for wave guides wherein the H-elbow is bent at an angle of 90° and illustrates curves for a few selected ratios of the dimension $x_H/a$ for the corner flattening or smoothing as illustrated in the dimensions in FIG. 1*b*. Proceeding from the ripple s which exists for an H-elbow measured over an entire wave guide pass band and the lower curve in FIG. 1*a* designated "0" is for a curve where the exterior corner of the H-elbow is not flattened and $x_H/a=0$. The curve designated 0 in FIG. 1*a* illustrates the variation of reflection and ripple with frequency relative to the angle bisecting cross-section plane in the wave guide extending from the apex of the bend to the internal corner bend. The disruptive reflection has a capacitive phase over the entire wave guide pass band because of the expanded broad side of the rectangular wave guide in the bend area. Since the wave guide does not have corner flattening, the rectangular wave guide will have a broad side that is locally expanded to different degrees and has a correspondingly greatly reduced $TE_{20}$ critical frequency ($\lambda cTE_{20}=a$). Also, a very noticeable maximum reflection occurs in the upper part of the wave guide pass band and the cause of this reflection is an undesired $TE_{20}$ resonance in the area of the bend.

A $TE_{201}$ resonance which is induced across the magnetic $TE_{10}$ field at the bend is formed in the bend area under the higher $TE_{20}$ critical frequency of the straight wave guide.

It is known in the previously referenced publication "Taschenbuch der Hochfrequenztechnik" to symmetrically flatten the H-elbow as illustrated in FIG. 1*b* at the outer corner with a conductive plane and the size of the flattening or smoothing plane is determined by means of the cathetus dimensions $x_H$. This flattening functions to counteract the broad side expansion of the non-flattened H-elbow and thus reduces the capacitive effect and increases the inner $TE_{20}$ resonance at the higher frequencies.

With the optimum corner flattening $x_{Ho}/a=0.64$ as disclosed in the publication "Taschenbuch der Hochfrequenztechnik" results in compensation of the ripple s in the center of the wave guide pass band as shown in FIG. 1*a* by the curve which is designated 0.64. However, the ripple s increases in the lower portion of the band pass up to a value of $s_u=1.4$ which corresponds to a reflection factor of $r_u=16.7\%$ and at the upper frequency band limit up to $s_o=1.23$ which corresponds to a reflection factor of $r_o=10.3\%$. These values of reflection cause a significant disruption in many cases where the wave guide is used and thus the method and apparatus for compensating the ripple factor by flattening the corner does not result in sufficient reduction of the reflection factor.

The publication "Taschenbuch der Hochfrequenztechnik" teaches how the values $x_H/a$ of the corner flattening is reduced or increased so as to shift the matched point above or below the center frequency of the pass band. However, undesirable increase of the reflection in the lower frequency band or, alternatively, in the upper part of the frequency band occur. As shown in FIG. 1*a*, the matched point in the limiting case can be carried down to $TE_{10}$ critical frequency of the wave guide if the value of the ratio of $x_H/a=0.74$.

SUMMARY OF THE INVENTION

It is therefore an object of the present invention to provide a device for further reducing the reflection factor over the entire pass band of the wave guide in an H-elbow wave guide.

With a rectangular wave guide H-elbow bent across the narrow side of the wave guide and having an outer corner symmetrically angled with a conductive flattening plane the present invention provides for the value of $x_H/a$ to be selected greater than the value of 0.73 where $x_H$ represents the distance between the point from the apex of the untruncated elbow to the junction point between the truncating plane and the short side of the wave guide as illustrated in FIG. 1*b* and a is the broad dimension of the wave guide. Furthermore, in the present invention, capacitive loading is provided in the wave guide elbow in the geometric median of the elbow.

The invention recognizes that if H-elbows with corner flattenings or smoothing where the ratio $x_H/a$ is greater than 0.73 are compensated significantly more than has previously occurred then as shown in FIG. 1*a* by the curve labelled 0.74 inductive residual ripples occur which can be compensated over a broad frequency range by a very simple additional measure.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 2:
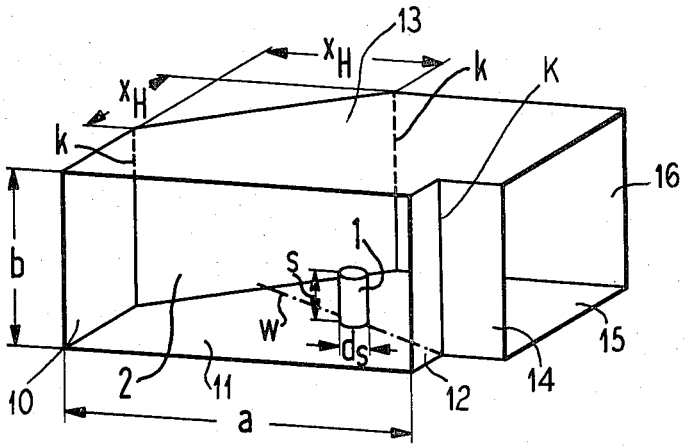
FIG. 2 is a perspective view of a sample embodiment of the invention.

FIG. 2 illustrates an example of the invention comprising a wave guide elbow bent across the narrow dimension b on a line K with the bend angle of the wave guide elbow being 90° and wherein flattening is accomplished with a flattening or smoothing plane 2 which engages the top surface 13, the side walls 10 and 16 and the bottom wall 11 of the wave guide. The flattening plane 2 also engages the side wall 16 as well as the bottom wall 15 of the output wave guide. In the invention, the cathetus dimension $x_H$ which extends from the junction point k of the plane 2 to the apex of the untruncated elbow has a ratio to the wide side a of the wave guide of $x_H/a=0.774$.

Figure 1A:
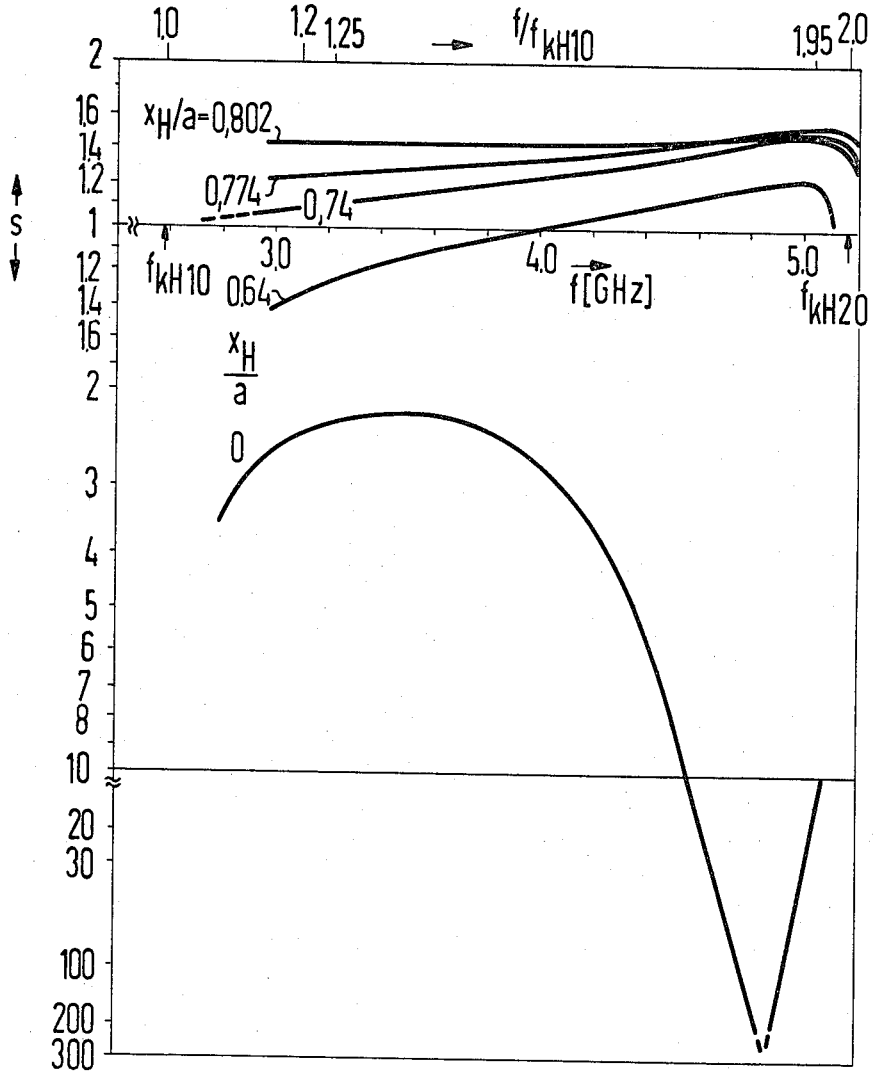
FIG. 1*a* comprises a plot of the standing wave ratios s of H-elbows with different values of $x_H/a$ of corner flattening.
Figure 1B:
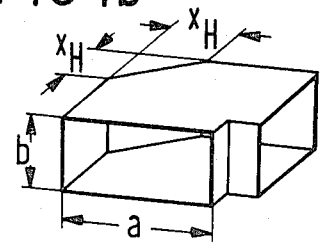
FIG. 1*b* illustrates an H-elbow with a symmetrical corner flattening.

In FIG. 1*a*, the second curve from the top of the graph is a plot for this value of a ratio of 0.774 and the ripple values s are entirely inductive relative to the angle bisecting cross-section plane of the H-elbow and are over-compensated and exhibit a tendency to increase slightly with an increase in frequency. The method of compensating over a broad frequency range which is optimum and which has as low as possible sum reflection comprises a conductive cylinder 1 which might be made of metal and which is mounted on the bottom wall 11 and extends into the internal space of the wave guide. The cylinder 1 is mounted on the median w which extends from the inside corner K to the center of the flattening plane 2. For optimum broad frequency band compensation, the metal cylinder 1 may be a simple metal screw which has a diameter of $d_s$ which is approximately 10% of the length of the wide side a of the wave guide. The height of the cylinder s is approximately 24% of the narrow side b of the wave guide for a value of $x_H/a=0.774$ of the relative corner flattening. In view of the two fold compensation by the flattening plane 2 and the cylinder 1, reflection factors below 1% occur over the entire frequency range of $1.2fcTE_{10} \leqq f \leqq 1.95\ fcTE_{10}$.

Figure 4:
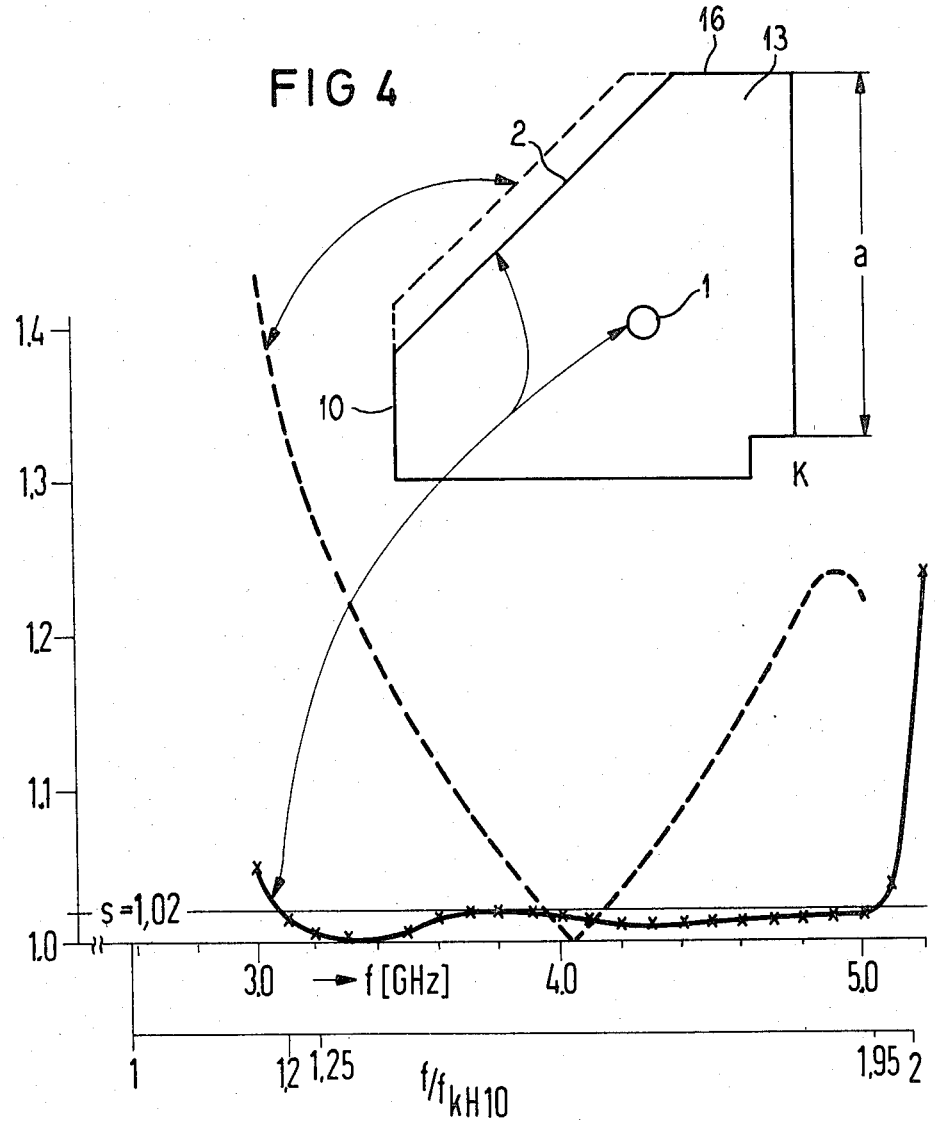
FIG. 4 comprises a plot of the reflection factor as a function of frequency for the H-elbow of the invention formed as shown in FIG. 2.

FIG. 4 illustrates the reflection curve in broken line of an H-elbow compensated only with optimum corner flattening wherein the ratio is $x_H/a=0.64$ corresponding to the dashed line of the top view of the wave guide and the s curve illustrated in solid line in FIG. 4 corresponds to the H-elbow utilizing the cylinder 1 and having a $x_H/a=0.774$ according to the invention and it is to be noted that the reflection of the doubly compensated H-elbow illustrated in FIG. 2 is reduced by at least a factor of 10 over the entire pass band of the wave guide.

Thus, particularly, it is advantageous that the inductive ripple of the H-elbow having a dimension of $x_H/a=0.774$ and the capacitive ripple of the relatively thin cylinder 1 are complementary over a broad frequency band particularly considering the field distortion in the H-elbow. The reflection of the H-elbow compensated as illustrated in FIG. 2 stays very low until it rises sharply only in the immediate vicinity of $TE_{10}$ critical frequency for f less than $1.2fcTE_{10}$ since the capacitive reactance of the compensating cylinder 1 no longer decreases but rather rises as illustrated in FIG. 6.5 on page 412 of the publication "Taschenbuch der Hochfrequenztechnik". In contrast, as illustrated in FIG. 1*a*, the inductive s values of the H-elbow with values of the ratio $x_H/a=0.774$ also decrease in this frequency range of $f<1.2fcTE_{10}$ almost linearly with decreasing frequencies so that the frequency response of the two compensation measures diverge more only in that frequency range.

The inventive H-elbow illustrated in FIG. 2 has the advantage that it has very low reflection up to the frequency of 1.95fold $fcTE_{10}$ which is the critical frequency of the straight wave guide. This can be explained from the fact that the "inner" $TE_{20}$ resonance is raised to even higher frequencies due to the stronger corner flattening ratio of $x_H/a=0.774$ than in the H-elbow which has a corner flattening ratio of $x_H/a=0.64$. As shown in FIG. 1*a*, the $TE_{20}$ resonance with a ratio of 0.64 begins to have an effect at $1.90fcTE_{10}$.

For a second example of a H-elbow which has very low reflection over a broad frequency range as shown by the s curve in FIG. 1*a* having the relative corner flattening of $x_H/a=0.82$ which occurs at the top of FIG. 1*a*. Such a H-elbow produces inductive values of ripple s which are nearly frequency independent over the entire pass band of the wave guide. For such elbow, the metal cylinder 1 should be a relatively thick cylinder which has a diameter $d_s$ which is approximately equal to 31% of the broad side a of the wave guide and which has an insertion depth or height s to be approximately 14% of the narrow side b of the wave guide. Because of the low insertion depth of the compensation cylinder such a H-elbow with the ratio of 0.802 can be loaded with a particularly high output.

Figure 3:
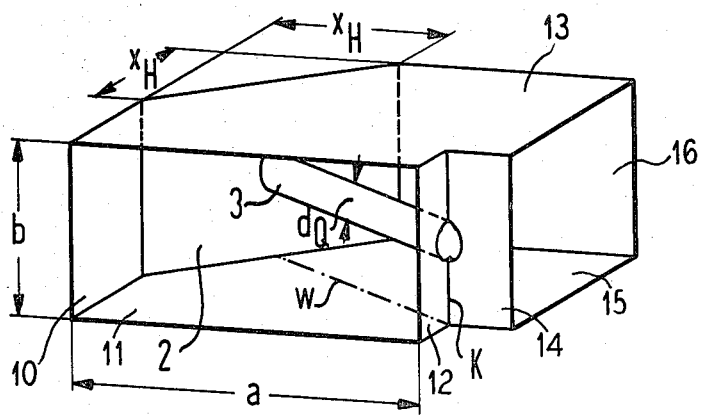
FIG. 3 illustrates a modified form of the invention.

A modification of the invention is illustrated in FIG. 3 wherein for compensation rather than the cylinder 1 illustrated in FIG. 2, a cylinder or cross-bar 3 extends from the inner corner K where the narrow side walls 12 and 14 intersect to the mid-point of the shortening plane 2 and thus the cylinder 3 extends at right angles to cylinder 1 in FIG. 2. In the arrangement of FIG. 3, the H-elbow has corner flattening of $x_H/a=0.74$ and the cylinder 3 extends in the geometrical median w from the bend or inner edge K to the wall 2. The diameter $d_Q$ of the cylinder 3 or cross-bar is selected to be approximately one-fourth of the length of the narrow side b of the wave guide.

FIG. 4 illustrates in solid line a curve plotted for the sample embodiment illustrated in FIG. 2 and the dashed line is a plot of a H-elbow having only corner flattening with the ratio of $x_H/a=0.64$. Thus, with use of the cylinder 1 (or 3) H-elbows can be designed so as to have reflection factors which are only one-tenth over the entire frequency band as compared to an elbow which has only a corner flattening and does not include the cylinders 1 or 3.

Although the invention has been described with respect to preferred embodiments, it is not to be so limited as changes and modifications can be made which are within the full intended scope of the invention as defined by the appended claims.

I claim as my invention:

1. A rectangular wave guide H-elbow bent across the narrow side of the wave guide and having an external corner symmetrically flattened with a conductive flattening plane, characterized in that the value $x_H/a$ of the corner flattening is selected so as to be greater than 0.73, whereby $x_H$ is the distance from the junction of the flattening plane with the narrow side (k) to the apex of the outer bend edge of a non-flattened elbow and "a" is the length of the broad side of the wave guide; and electrically conductive means (3) functioning as a capacitive load are provided in the wave guide elbow in the area of the geometrical median (w) of the bend, in that a conductive cross-bar (3) which extends between the flattening plane (2) to the inner bend edge (K) is provided as the capacitive load electrically conductive means.

2. A rectangular wave guide elbow bent across the narrow side of the wave guide according to claim 1, characterized in that the ratio $x_H/a$ of the relative corner flattening is at least approximately 0.740, and the diameter $d_Q$ of the conductive cross-bar (3) is approximately one-fourth of the narrow side b of the wave guide.

3. A rectangular wave guide H-elbow bent across the narrow side of the wave guide and having an external corner symmetrically flattened with a conductive flattening plane, characterized in that the value $x_H/a$ of the corner flattening is selected so as to be greater than 0.73, whereby $x_H$ is the distance from the junction of the flattening plane with the narrow side (k) to the apex of the outer bend edge of a non-flattened elbow and "a" is the length of the broad side of the wave guide; and cylindrically conductive means (1) functioning as a capacitive load are provided in the wave guide elbow in the area of the geometrical median (w) of the bend, wherein the ratio $x_H/a$ of the relative corner flattening is at least approximately 0.802, and said cylindrically conductive means (1) has a diameter $d_s$ of approximately 31% of the broad side a of the wave guide and has an insertion depth s of approximately 14% of the narrow side b of the wave guide.

* * * * *